United States Patent [19]

Sylvester

[11] 4,192,182

[45] Mar. 11, 1980

[54] METHOD FOR PERFORMING STEP RATE TESTS ON INJECTION WELLS

[76] Inventor: G. Clay Sylvester, 4101 Skyline, Midland, Tex. 79703

[21] Appl. No.: 961,055

[22] Filed: Nov. 16, 1978

[51] Int. Cl.[2] ..... E21B 47/06

[52] U.S. Cl. ..... 73/155; 166/271

[58] Field of Search ..... 73/155; 166/252, 266, 166/268, 269, 270, 305 R, 308, 271

[56] References Cited

U.S. PATENT DOCUMENTS

| | | | |
|---|---|---|---|
| 3,338,095 | 8/1967 | Johnson et al. | 73/155 |
| 3,636,762 | 1/1972 | Kuo etal. | 73/155 |

*Primary Examiner*—Jerry W. Myracle
*Attorney, Agent, or Firm*—Carl B. Fox, Jr.

[57] ABSTRACT

Method for performing step rate tests on injection wells, including inserting a portable pumping unit to receive the water or other fluid normally injected into the well and controlling its pressure, and then increasing the pressure of the injection fluid to a predetermined pressure by use of the portable pumping unit to determine fluid flow at said predetermined pressure, the fluid at the predetermined pressure being pumped continuously until a stable flow rate is achieved. The procedure is repeated for plural stepwisely increased pressure points at each side of the fracture pressure, whereby the fracture pressure is accurately determined.

9 Claims, 2 Drawing Figures

METHOD FOR PERFORMING STEP RATE TESTS ON INJECTION WELLS

BACKGROUND OF THE INVENTION

Step rate tests, sometimes called formation pressure parting tests, are performed on injection wells for the purpose of determining the fracture pressure of a petroleum formation into which a fluid, usually water, is pumped through the injection well. Injection wells are located at diverse points of a formation and fluid is pumped thereinto for the purpose of driving petroleum materials in the formation toward one or more production wells through which the petroleum material may be brought to the surface, or produced. A lease pump is connected to the several injection wells through a pipe manifold so that the water pumped by the lease pump is distributed to all of the injection wells connected to the manifold to simultaneously inject the water into the formation through all of the injection wells, thereby forcing the petroleum material from the directions of all of the injection wells toward the production well or wells.

Step rate tests are performed by pumping water through the well into the formation at stepwisely increased pressure levels, the flow rate being held constant until the pressure stabilizes or becomes constant at each pressure level, or the pumping pressure being held constant at each pressure level until the flow rate becomes constant. Heretofore, the procedure has been performed in most cases by one of the following procedures.

By one procedure, which can be used only if the lease pump being used for injection has adequate pressure and flow rate capacities, the step rate test may be performed without any special equipment. The volume of fluid being pumped into the well is increased by steps, permitting pressure to become constant at each step, until the test is complete. But if the lease pump being used does not have adequate pressure and flow rate capacities, then other procedures must be used. For this procedure, injection flow to other injection wells manifold to the well being tested must be shut down in order that all of the lease pump capacity may be used for the test. Shutting down the other injection wells for a test is a time consuming and expensive procedure.

Another customary procedure is to disconnect the flow line through which water is being injected into the well, and to connect thereto a transport pump truck having its own water supply tanks and to run the step rate test by using the transport pump truck to pump water or other fluid into the well at stepwisely increased pressures until the test is completed. This, also, is a time consuming and expensive procedure. Rental of transport pump trucks is expensive, and additional tank trucks may be required to bring water to the test site.

Another procedure for accomplishing step rate tests on injection wells is accomplished by transporting a water tank to the site, filling it up with water, and then using a pump truck to pump water into the injection well at sufficiently high pressures for performance of the step rate test. This, too, is a time consuming and costly procedure.

This invention seeks to provide in a new and novel manner, methods for performing step rate tests at reduced costs and with greater efficiency, and without interruption of operations as to other injection wells.

SUMMARY OF THE INVENTION

According to the invention, methods are provided whereby step rate tests may be performed in a simple and reliable manner. The step rate tests are performed by breaking the flow line running from the lease pump manifold to an injection well to be tested, and connecting thereinto a portable pumping unit which includes a central valve, a surge tank, a positive displacement pump, and a flow meter. Control and balancing of pressures received from the lease pump manifold and throughout the portable pumping unit system are necessary in order that the tests may be satisfactorily performed. The method eliminates the need for a separate water supply, which is required in the case of two of the methods conventionally used for step rate testing, and enables rapid setting up of the equipment and performance of the tests without any extended delays. Use of the portable pumping unit required for the methods according to the invention eliminates the need for expensive transport pump trucks and water pump trucks and eliminates the need for moving portable tanks to the well site for performance of the tests. Time delays in hauling water to the site and filling of the tanks for tests is also eliminated, whereby the overall test procedure is simplified and made more economical and less time consuming.

A principal object of the invention is to provide methods for performing step rate tests. Another object of the invention is to provide such methods which are economical and efficient. A further object of the invention is to provide such methods wherein water from the lease pump manifold system is utilized in performance of the tests. Yet another object of the invention is to provide such methods wherein a separate water supply is not required. Yet another object of the invention is to provide such methods which afford completely satisfactory control during testing, whereby test results are improved.

Other objects and advantages of the invention will appear from the following detailed description of preferred embodiments thereof, reference being made to the accompanying drawings.

BRIEF DESCRIPTIONS OF THE DRAWINGS

DESCRIPTION OF THE PREFERRED EMBODIMENTS

Figure 1:
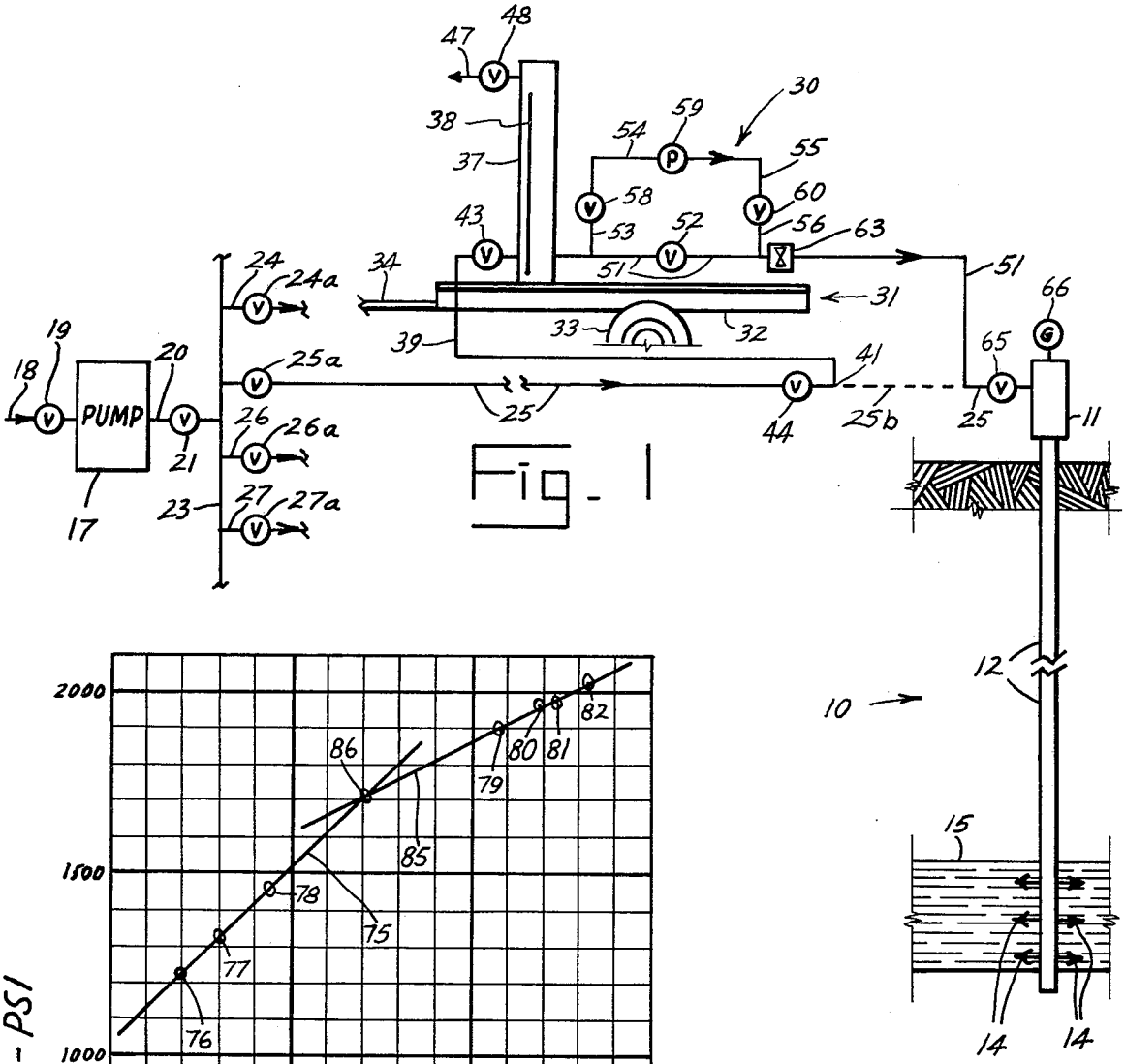
FIG. 1 is a schematic flow diagram showing a method of preferred form according to the invention.

Referring now to the drawings in detail, and first to FIG. 1, there is shown an injection well 10 having wellhead 11, casing or casings 12, and having a plurality of perforations 14 where casing 12 passes through a subterranian petroleum formation 15.

A lease pump 17 pumps water from a water supply (not shown) through conduit 18 flow through which is controlled by valve 19. The pump output passes through conduit 20, flow through which is controlled by valve 21, through manifold pipe or pipes 23 from which pipes 24–27 branch, flow through the branch pipes being controlled by valves **24*a*–27*a*, respectively. Manifold 23** may be connected to additional branch pipes, not shown.

Pipe or conduit 25 extends to wellhead 11 of injection well 10, as shown, the portion **25*b* shown by a dashed line normally being in place so that pipe 25 is continuous to the wellhead 11. Portion 25b of pipe 25 may be of any length, or may have no length at all with the portable pump unit being connected at the opposite parts of a disconnected pipe joint. The injection well may be at a considerable distance from the lease pump 17**.

Portable pumping unit 30 supported by trailer 31 is shown schematically. Trailer 31 is shown to have bed 32, wheels 33, and tongue 34, this showing being illustrative only, and any suitable vehicle may be used to transport the pumping unit. Trailer 31 supports a vertically elongated tank 37, which functions as a surge tank. Tank 37 may, for example, be one foot in diameter and six feet in height. Other sizes of tanks may be employed, so long as the performance herein referred to is attained. A separator or baffle 38 in the form of a flat plate is disposed across the tank, spaces being provided both below the baffle and above the baffle, as shown. Conduit 39 connected to a lower portion of tank 37 is temporarily connected to the end of pipe 25 at 41 for the purpose of making a step rate test. Dashed-line portion 25b of pipe 25 being temporarily removed for this purpose. Pipe 39 has therein a valve 43, valve 43 being used as a control valve, and a ball valve being suitable for this purpose. Any other form of valve which will serve the required control purposes may be used. Valve 44 is provided in pipe 25 in order that flow may be cut off while pipe portion 25b is removed and pipe 39 is connected. If no valve 44 is provided, the valve 25a may be closed for the same purpose.

Near the upper end of tank 37, a conduit 47 controlled by a bleed valve 48 is provided for the purpose of venting gases from the upper end of tank 37 and for relief of pressure within the tank should same become necessary. Tank 37 is usually operated with the liquid level therein up to the level of conduit 47, conduit 47 being temporarily opened until water overflows so that it can be ascertained that the tank is filled to this level.

Pipe 51 is connected to the lower portion of tank 37, as shown. A valve 52 is provided in pipe 51. Pipes 53–56 connect between pipe 51, valve 58, pump 59, valve 60 and back to pipe 59 at the opposite side of valve 52, as shown. A flow meter 63 is provided in pipe 51 beyond the connection of pipe 56 thereto. Pipe 51 leads to a connection with pipe 25 at the righthand end of where the dashed-line portion 25b was removed. Wellhead 11 has valve 65 to control liquid flow through pipe 25 at the wellhead. A pressure indicator 66 is provided at the upper end of wellhead 11.

The manner of performance of step rate tests has been briefly indicated hereinbefore. To perform a step rate test which is also sometimes referred to as a formation pressure parting test, a liquid, usually water, is introduced into the well at a number of separate fixed flow rates or pressures. As stated above, the pressure or the flow rate may be held constant to perform a test, the other being allowed to stabilize or become constant. Liquid input at each fixed flow rate or pressure is continued until such time as the pressure or the rate of flow into the well becomes stabilized or constant. The liquid flows down the conduit 12 and out of the perforations 14 into formation 15. Once the pressure or flow rate has become stabilized, a record is made of the flow rate at that pressure. Then, the pressure is increased to a higher value and the process repeated, whereby a higher flow rate is determined for the higher pressure after the flow rate has become stabilized, or vice versa. The process may be repeated any suitable number of times in order to determine the direction of a line such as the line 75 shown in FIG. 2. Points 76–78 indicate points determined in this manner. For example, point 76 is determined at a pressure of 1220 pounds per square inch and a flow rate of 200 barrels per day, this being the point at which the pressure or flow rate became stable. Point 77 indicates a pressure of 1330 pounds per square inch and a flow rate of 300 barrels per day. Point 78 indicates a pressure of 1460 pounds per square inch and a flow rate of 440 barrels per day.

Figure 2:
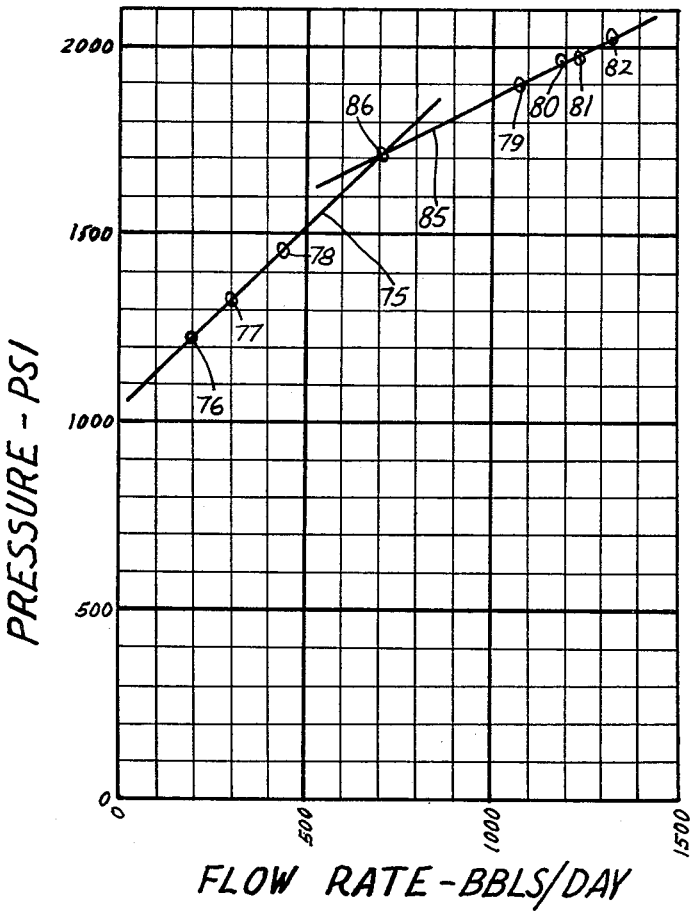
FIG. 2 is a graph indicating exemplary results achieved during a step rate test.

After the direction of line 75 has been established, the flow rate or pressure is increased further, for example, to a pressure of 1900 pounds per square inch, at which pressure the flow rate was 1080 barrels per day, this being indicated at point 79 on the graph shown in FIG. 2. Points 80–82 are established in the same manner at step-wise increases of flow and pressure, each point being determined by the stable flow rate or pressure. Points 79–82 indicate the direction of line 85. When lines 75 and 85 have been determined and plotted on a graph, such as that shown in FIG. 2, the point of intersection 86 of the two lines may be ascertained, which indicates the pressure break point or fracture pressure of the formation to be 1710 pounds per square inch.

It will have been noted that the slopes of lines 75 and 85 are not the same. The lesser slope of line 85 on the graph indicates that flow increases more rapidly with increases of pressure than is indicated for line 75. This means that the fracture point of the formation into which the injection fluid is being introduced has been exceeded, point 86 indicating the fracture pressure for the formation. Points such as points 76–78 are determined with stepwise increases in pressure and the resulting points, which may be plotted on a graph, are determined. Since the location of point 86 is not at that time known, it will not be known in advance when the points will be on line 85 instead of on the initial line 75. But this is readily determined after a sufficient number of points have been determined, by plotting them on a graph, and in that way determining that the increase of flow rate with increased pressure has occurred.

A sufficient number of points on a line 75, and a sufficient number of points on a line 85, should be determined by stepwise increases of pressure to ascertain definitely the accurate directions of the lines, so that accurate location of the point 86 may be assured. If insufficient numbers of points for each line are determined, then the results may be somewhat inaccurate.

As is well known in the art, the purpose of an injection well is to force a petroleum product through a formation toward one or more production wells. The production well or wells will be located at the point toward which the formation fluids are to be forced. The injection wells are located at points of the formation such that fluid injection thereto will force the fluids toward the production well or wells. A plurality of injection wells is invariably used. The lease pump 17 is brought to the location where the injection wells are to be operated. A water supply is established so that pump 17 may pump water into the manifold 23 which distributes the water to all of the injection wells. Of course, it is possible that two lease pump manifold systems or more may be employed. The pipes 24–27 each leads to an injection well into which water is constantly pumped or injected by pump 17. For operation of the injection well system, it is necessary to determine the fracture pressure of 40 formation so that proper operation of the injection system may be performed.

When the pressure and liquid flow output of the lease pump 17 is sufficient, step rate testing may be done for low pressure steps using the pressure and flow output of pump 17 operating through portable pumping unit 30. Points on a line 75 may be established by opening valves 25*a*, 44, 43, 52, and 65, and closing valves 58 and 60. Operation of valve 43 then controls flow through the system, the water coming from pump 17 through conduits 25, 39 into tank 37, and thence through pipe 51 to wellhead 11. The pressure is indicated by gage 66, while the flow rate is determined by flow rate indicator 63. When the pressure output of pump 17 becomes insufficient, valve 52 is closed and valves 58 and 60 are opened, with pump 59 being started in operation. Thereafter, additional points on lines 75 and 85 may be determined at higher pressures and higher flow rates. In many cases, the output of pump 17 will be insufficient to determine any point on line 75.

When pump 59 is operated to perform tests according to the method, valve 43 is opened enough to create a pressure at the downstream side of valve 43 of between just above zero and about 200 pounds per square inch. This is done in order to create a low suction pressure for pump 59, at sufficient pressure to fill the chamber of pump 59 for each stroke. Water enters tank 37 through valve 43 at the lefthand side of baffle 38, and flows around the baffle either thereabove or therebelow to the outlet at pipe 51. Pump 59 increases the liquid pressure to the test pressure. The test pump 59 is preferably of a capacity to pump fluid at up to about 3000 psi flowing pressure at a flow rate of up to about 3000 barrels per day. Pumps having less capacity can be employed if capacities as high as this are not required for the tests. For example, with reference to FIG. 2, the pressure shown for point 82 is about 2200 psi at a flow rate of about 1320 barrels per day, so it is evident that a pump of lesser capacity than herein stated may be employed. But in order to handle substantially all wells for which the method may be applied, a pump of the pressure and flow rate capacity indicated is desirable.

The lease pump will usually have a maximum pressure capacity of about 2000 psi and a maximum flow rate of around 5000 barrels per day. Therefore, pressure and flow from pump 17 may be employed for testing only when pressures and flow rates within its limits is necessary. It will be realized that the lease pump, during injection into the multiple injection wells, pump only a proportion of its flow capacity to each injection well, the flow being divided between the several injection wells. The pressures in lines 24–27 at the manifold are equal, while the pressures adjacent the injection wells are somewhat lower because of line losses.

Since all of valves 24*a*–27*a* are left open during testing pf a single well, that is, fluid injection to the other injection well is continued during testing, if necessary to supply well 10 with sufficient liquid volume, the volumes going to the other injection wells are reduced during the tests, but is notable that injection to all of the injection wells need not be shut down to perform a test on a single injection well.

The test pump 59 is a positive displacement pump the capacity of which is altered by altering its speed of operation. During the determination of the series of pressure test points for a well, valve 43 is adjusted for each pressure level in order to maintain the pressure downstream of valve 43 constant. This requires opening of the ball valve as the pressure delivered by pump 59 is increased from one step to another. Again, the pressure and volume output of test pump 59 is increased by increasing its speed of operation.

FIG. 2 provides an example of operation according to the method. During the tests, valves 24*a*–27*a* all were left in open condition, valves 44 and 65 being temporarily closed in order that the portable pumping unit could be attached at point 41 and to pipe 25 at the wellhead. After the test apparatus was connected to the well, valves 44 and 65 were opened fully. During the test, valve 43 was manipulated in order to maintain a constant suction pressure for pump 59. Pump 59 was first run at a speed to give a 1220 psi pressure of the injected water, and was successively increased in speed of operation for the higher pressures of test points 76–82 on the graph. Globe valve 43 was opened to a greater degree for each higher pressure in order to maintain a constant pump suction pressure. A gage (not shown) may be provided to indicate this pressure. Flow rates for each pressure were determined by the use of flow rate gauge 63, and the injection pressure was observed at gauge 66.

Upon completion of the test, valves 44 and 65 were closed while the test equipment was disconnected and pipe section 25*b* replaced, after which valves 44 and 65 were reopened so that normal injection caused by pump 17 would proceed.

The results of the exemplary test is shown in FIG. 2, previously described. Drawing of the two lines 75 and 85 on the graph determined fracture point 86, the object of the test.

As should by now be clear, the test method provides a much simplified procedure for performing step rate tests at low cost and with suitable accuracy. The equipment required is relatively inexpensive as compared with equipment used by other tests procedures.

While a preferred embodiment of the method has been described and illustrated in the drawings, many modifications thereof may be made by a person skilled in the art without departing from the spirit of the invention, and it is intended to protect by Letters Patent all forms of the invention falling within the scope of the following claims.

I claim:

1. Method for performing step rate tests on injection wells of the type into which water is injected by an injection pump to drive petroleum materials through a subterranean formation toward a production well, there being plural conduit means each leading from a manifold at said injection pump to an injection well, comprising breaking one of said conduit means leading from said injection pump to a single injection well, connecting a portable pumping unit across said break in series with said one conduit, controlling the pressure of water delivered by said injection pump through said one conduit means to the inlet of said portable pumping unit, operating said portable pumping unit to increase the pressure of said water delivered thereto from said controlled pressure to an injection pressure, delivering said water at said injection pressure through said single injection well into said formation while monitoring at least one of the flow rate and injection pressure thereof until the flow rate and injection pressure become at least substantially constant, repeating the described injection procedure at different flow rates and injection pressures below and above the fracture pressure of said single injection well and determining constant flow rates and injection pressures at plural levels, and determining the fracture pressure of the formation from the difference in flow rates at different injection pressures.

2. Method according to claim 1, wherein said portable pumping unit is provided to include a control valve and a surge tank and a positive displacement pump and a flow meter in series, and wherein said portable pumping unit is connected across said break whereby water delivered by said injection pump is delivered through said control valve to said surge tank before reaching said positive displacement pump.

3. Method according to claim 2, wherein a baffle is provided across said surge tank between the inlet and outlet thereof, said surge tank pressure being controlled by said control valve to a constant low pressure sufficient for proper operation of said positive displacement pump.

4. Method according to claim 3, said constant low pressure being from somewhat above zero pressure upward to about 200 pounds per square inch.

5. Method according to claim 1, 2, 3, or 4, wherein said selected injection pressures are in the range from about 20 pounds per square inch to about 3000 pounds per square inch.

6. Method according to claim 1, 2, 3, or 4, wherein said constant flow rates are in the range up to about 3000 barrels per day.

7. Method according to claim 1, 2, 3, or 4, including transporting said portable pumping unit to the injection well site on a movable vehicle.

8. Method according to claim 1, 2, 3, or 4, including recoupling said one of said conduit means at said break after said step rate test has been completed.

9. Method according to claim 1, 2, 3, or 4, including plotting each said constant flow rate on a graph versus the selected injection pressure corresponding thereto, drawing a first straight line on said graph at the location and slope indicated by said determinations at selected injection pressures below said fracture pressure of said single injection well and drawing a second straight line on said graph at the location and slope indicated by said determinations at selected injection pressures above said fracture pressure of said single injection well, and reading said fracture pressure of said single injection well from said graph at the point of intersection of said first and second straight lines.

* * * * *